US005351702A

United States Patent [19]

Denjean

[11] Patent Number: 5,351,702

[45] Date of Patent: Oct. 4, 1994

[54] WALKING AID DEVICE OF THE CRUTCH OR ENGLISH CANE TYPE

[75] Inventor: Francois Denjean, La Tour-du-Pin, France

[73] Assignee: FDI Francemedical, France

[21] Appl. No.: 154,293

[22] Filed: Nov. 18, 1993

[51] Int. Cl.[5] ..... A61H 3/02

[52] U.S. Cl. ..... 135/71; 135/72; 280/821

[58] Field of Search ..... 135/65, 71, 72, 76; 280/821

[56] References Cited

U.S. PATENT DOCUMENTS

| | | | |
|---|---|---|---|
| 2,231,337 | 2/1941 | Knoedler | 135/76 |
| 2,516,852 | 8/1950 | Burry et al. | 135/71 |
| 4,572,545 | 2/1986 | Dooley, Jr. et al. | 280/821 |

FOREIGN PATENT DOCUMENTS

| | | | |
|---|---|---|---|
| 242287 | 11/1960 | Australia | 135/71 |
| 1594757 | 6/1970 | France . | |
| 1302191 | 1/1973 | United Kingdom . | |
| 3005749 | 4/1993 | World Int. Prop. O. | 135/71 |

*Primary Examiner*—Carl D. Friedman
*Assistant Examiner*—Lan C. Mai
*Attorney, Agent, or Firm*—Ostrolenk, Faber, Gerb & Soffen

[57] ABSTRACT

The upper portion is comprised of an angled metal tube (2) assembled to a cast plastic part (3) having a handle (30) and an arcuate extremity (31) connected by an elongate body (32) the internal face (33) of which assumes the contour of the tube (2) over approximately half the circumference and which has an orifice (37) facing two orifices (22, 23) which are diametrally opposite in the tube (2) and which are facing an orifice (43) provided in a counter-part (4) having one face (42) partially assuming the contour of the tube (2) and an assembly screw (5) enabling the tube (2) to be affixed to the part (3) and to the counter-part (4).

4 Claims, 3 Drawing Sheets

WALKING AID DEVICE OF THE CRUTCH OR ENGLISH CANE TYPE

The present invention comprises a walking aid device of the crutch or English cane type, and more particularly the upper part thereof used for gripping and to support the forearm of the user.

In general, a walking aid device of the crutch or English cane type comprises a metal tube of adjustable length, at the lower end of which is fixed an anti-slip tip, and to the other end of which is solidly fixed a handle which is substantially perpendicular to said tube and which is extended obliquely upwards, this extension having at its end an arcuate piece serving as a support for the forearm.

The upper portion of such a device, that is to say the portion comprising the handle, the oblique extension and the arcuate piece, is generally produced in a single piece, and most frequently in molded plastic.

The solid fixing of the upper portion and of the metal tube is generally undertaken by fitting the latter into a tubular extension of said upper portion, disposed below the handle.

This solid fixing has disadvantages, in particular in respect of resistance to force, this resistance being closely linked to the resistance of the plastic employed and the thickness of the tubular portion produced from this plastic, so that such walking aid devices have a weight limit indication, which is generally of the order of 90 kg.

This is because the forces to which these walking aid devices are subjected are not always located in the axis of the tube, which may give rise to a shearing effect at the level of connection between the latter and the plastic upper portion; on the other hand, a violent force may result in the separation of the arcuate portion serving as support for the forearm.

To remedy this disadvantage, it has been proposed that the link between the upper portion and the arcuate portion should be reinforced by the addition of material, but this procedure has the disadvantage of increasing the weight and cost of the device. It has likewise been proposed that the upper piece should be produced entirely from steel, which imparts great strength thereto but substantially increases the weight of the device thus produced.

The present invention makes it possible to remedy these various disadvantages of the known devices by proposing a walking aid device which offers a resistance to force greater than that of the existing devices while nevertheless offering an improved aesthetic appearance.

The walking aid device constituting the subject of the present invention comprises, according to a first feature, an upper angled metal tube, in the lower portion of which a lower tube slides with a view to adjusting the length of said device, said upper tube extending as far as the upper end of the device, that is to say as far as the portion serving as an arm support.

According to a second feature of the invention, the portion serving as an arm support, and the handle, are produced from a single piece of rigid molded plastic which is attached to the upper portion of the angled tube.

The positioning of the handle may be variable, being at the level of the angle of the tube, or above on the oblique portion thereof, or alternatively below on the straight portion thereof.

The molded plastic piece of the device according to the invention comprises a handle and an arcuate portion connected by an elongate body whose internal face, in contact with the angled tube, assumes the contour of the latter over about a half-circumference.

Said piece of molded plastic is solidly fixed to the angled tube by any appropriate means, such as a screw-and-nut system, being associated to this end with a curved counter-part disposed on the other half-circumference of the tube, the three pieces in question being pierced by mutually facing orifices.

The placing of the counter-part may be variable, but it is advantageous to place it as close as possible to the handle and even facing the latter, and to use a screw which may be deeply introduced into the handle, which comprises to this end a solid reserve of material allowing the sound anchoring of the screw and increasing the shear strength of the handle.

The upper end of the plastic piece comprises a plug element which is introduced into the angled tube and thus helps to support the upper portion of said piece on said tube, while the arcuate portion serving as an arm support may adopt different shapes and sizes.

The walking aid device forming the subject of the present invention has a greater resistance to force than that of the existing devices, by virtue of the mode of assembly of the tube and of the gripping portion, and it further permits the production of shapes whose aesthetic effect is novel.

The advantages and the features of the present invention will be more clearly apparent from the description which follows and which relates to the attached drawing, which represents various non-limiting embodiments thereof.

Figure 1:
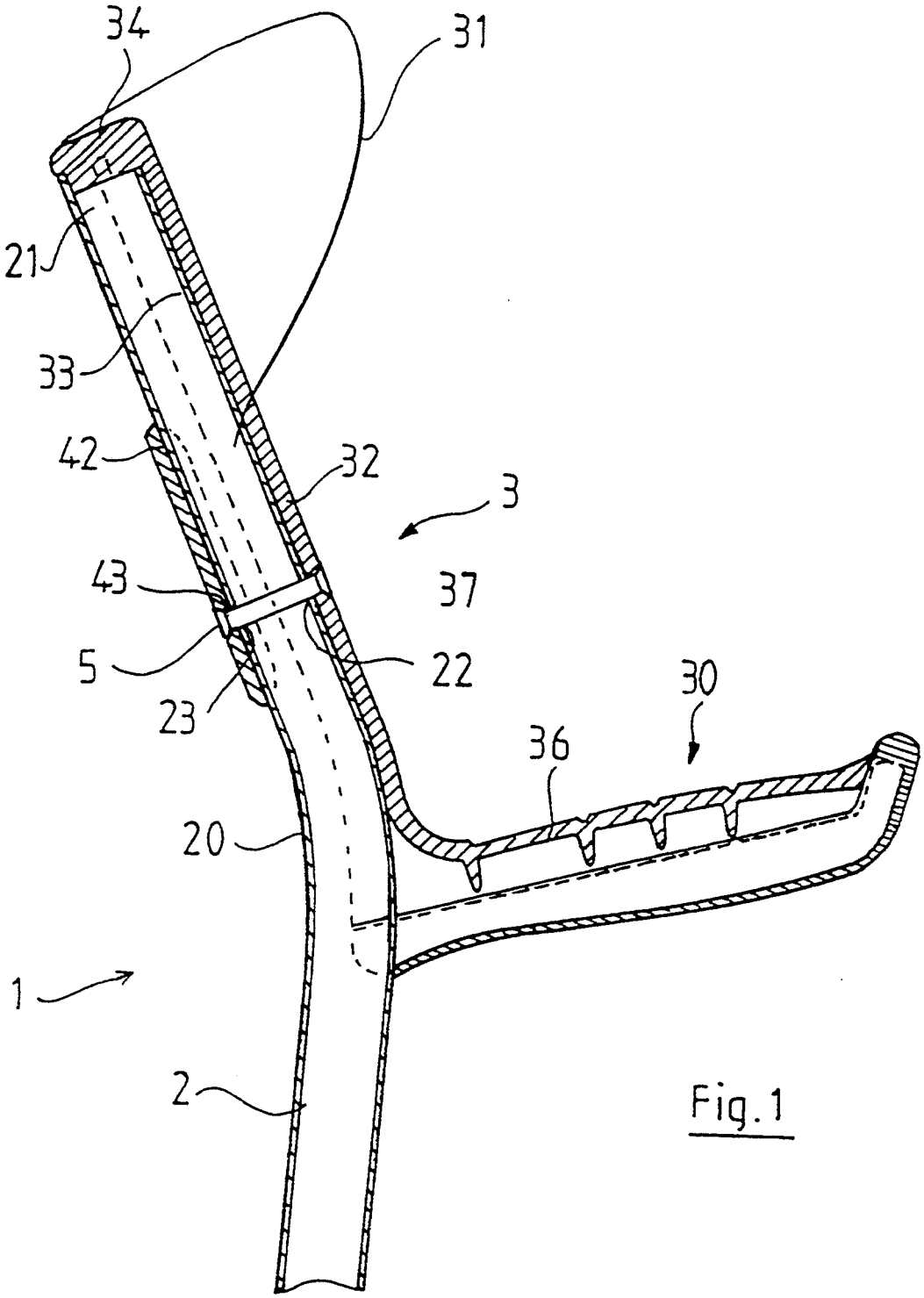
FIG. 1 shows a view in vertical section of the upper portion of a first embodiment of a walking aid device according to the invention.

If reference is made to FIG. 1, it can be seen that a walking aid device 1 according to the invention comprises an upper tube 2 having an angle 20, on which is fixed a piece 3 of molded plastic comprising, at its base and substantially perpendicularly, a handle 30 and, at its upper end, an arcuate portion 31 serving as an arm support.

The handle 30 and the arcuate portion 31 are connected by an elongate body 32 whose internal face 33 assumes the shape of the tube 2 from the angle 20 as far as its end 21.

The elongate body 32 comprises, at its upper end and behind the arcuate portion 31, a cork-type element 34 adapted to the internal dimensions of the tube 2, into the end 21 whereof it is introduced, thus partially solidly fixing the piece 3 to the tube 2.

At a short distance above the angle 20, the tube 2 is pierced by two diametrally opposed orifices 22 and 23, opposite which are disposed firstly an orifice 37 pierced in the body 32 of the piece 3 and secondly an orifice 43 pierced in a counter-part 4, one face 42 thereof partially assumes the contour of the tube 2, these three pieces being solidly fixed by screwing by means of an assembly screw 5.

Figure 2:
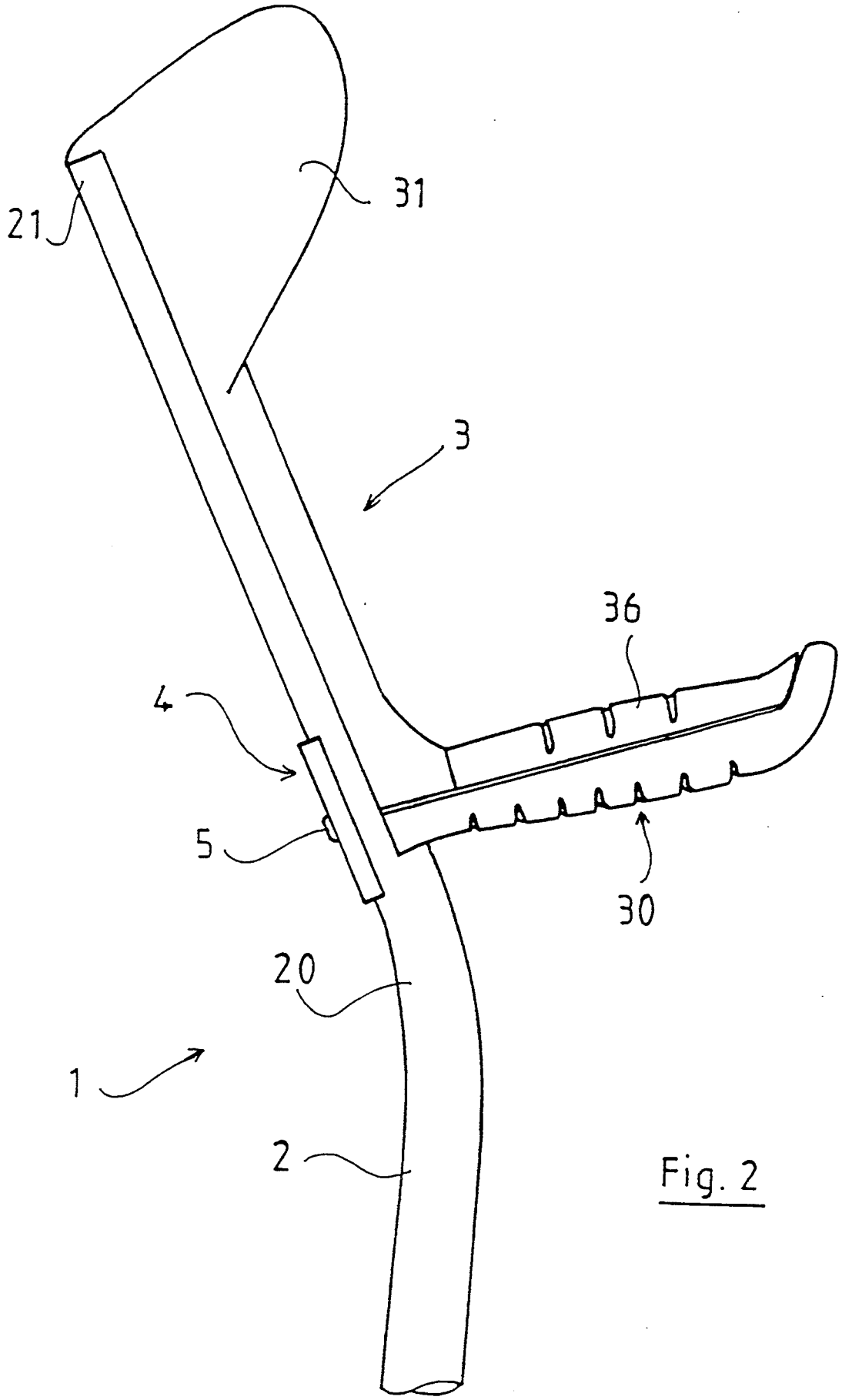
FIG. 2 shows a profile view of a second embodiment of such a device.

If reference is made to FIG. 2, it can be seen that, in this embodiment, the counter-part 4 is disposed facing the handle 30, the screw 5 being screwed into the material constituting said handle 30, which comprises, at its end in contact with the tube 2, a solid reserve of material, not visible in the figure, allowing the anchoring of the screw 5.

Figure 3:
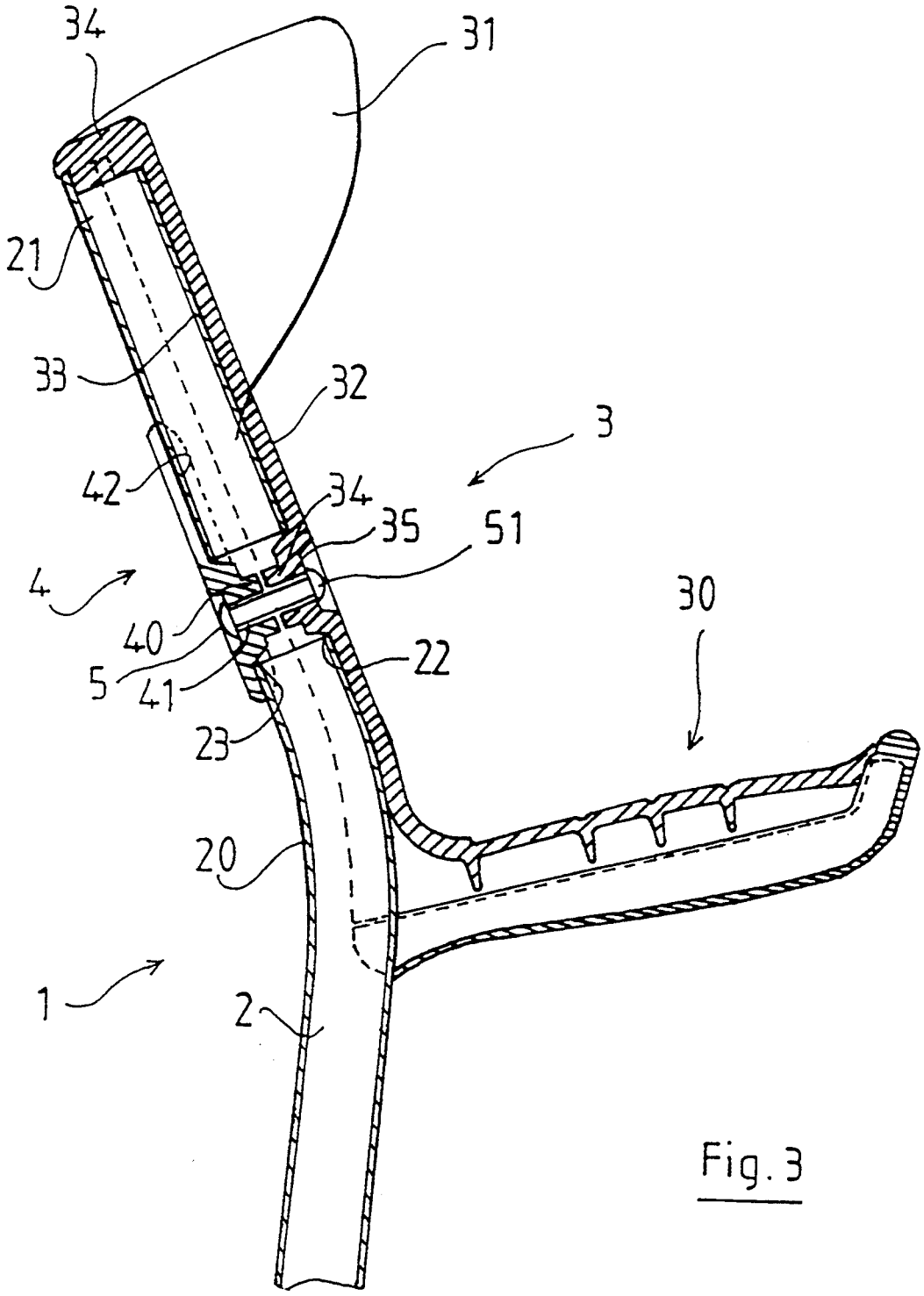
FIG. 3 shows a view in vertical section of a third embodiment of the device according to the invention.

If reference is made to FIG. 3, it can be seen that, in this embodiment, the internal face 33 of the piece 3 comprises a protuberance 34 which is pierced, centrally and perpendicularly to the longitudinal axis of the piece 3, by an orifice 35, and which is introduced into an orifice 22 made in the tube 2.

A second orifice 23, diametrally opposed to the orifice 2, is made in the tube 2 with a view to sheltering the protuberance 40, similar to the protuberance 34 of the piece 3, of a counter-part 4.

This counter-part 4 comprises a face 42 partially assuming the contour of the tube 2, and the protuberance 40 is centrally pierced by an orifice 41.

The assembly of the piece 3 and of the counter-part 4 onto the tube 2 is carried out by means of a screw 5 introduced into the orifices 35 and 41 and passing through the tube 2 via its orifices 22 and 23, associated with a nut 51.

It will be seen that, in this embodiment, the assembly means constituted by the protuberances 34 and 40 with the pieces 3 and 4 and the orifices 22 and 23 of the tube 2 is positioned substantially at the level of the middle of the piece 3, but this positioning may be different.

In all the embodiments which have just been described the upper portion 36 of the handle 30 may be removable, permitting replacement thereof, and it may be produced in a flexible material, of the foam type, increasing the comfort of using the device.

It is self explanatory that the present invention cannot be restricted to the preceding description of certain embodiments thereof, which are capable of undergoing modifications without thereby departing from the scope of the invention.

I claim:

1. A walking aid device of the crutch or English cane type, wherein the upper portion thereof comprises an angled metal tube assembled on a molded plastic piece comprising a handle and an arcuate end connected by an elongate body, said elongate body having an internal face wherein said internal face assuming the contour of the tube ove about a half-circumference, said elongate body having a hole disposed opposite two diametrically opposed holes made in the tube, a counter-part whereof one face partially assumes the contour of the tube, said counter-part including an aperture wherein said aperture being positioned opposite the holes in the tube, an assembly screw passing through the holes and aperture to enabling the tube to be solidly fixed to the piece and to the counte-part.

2. The device as claimed in claim 1, wherein the counter-part (4) is positioned substantially at the middle of the piece (3), the screw (5) being associated with a nut (51).

3. The device as claimed in claim 1, wherein the counter-part (4) is positioned facing the handle (30), the screw (5) being screwed into the material constituting said handle (30), said handle comprises, at the end in contact with the tube (2), a solid reserve of said material.

4. The device as claimed in claim 1, wherein the elongate body (32) of the piece (3) comprises a protuberance (34) introduced into an orifice (22) made in the tube (2) and pierced centrally by an orifice (35) intended to come opposite an orifice (41) pierced centrally in a similar protuberance (40) projecting on the internal face of a counter-part (4) and introduced into an orifice (23) made in the tube (2) diametrally opposite the orifice (22).

* * * * *